US006314878B1

(12) United States Patent
Wolff et al.

(10) Patent No.: US 6,314,878 B1
(45) Date of Patent: Nov. 13, 2001

(54) DAMPENING SYSTEM FOR OFFSET PRINTING PRESS AND METHOD

(75) Inventors: Douglas Wolff, Crystal Lake; Jiing-Kang Lin, Naperville, both of IL (US)

(73) Assignee: Ryco Graphic Manufacturing, Inc., Wheeling, IL (US)

( * ) Notice: Subject to any disclaimer, the term of this patent is extended or adjusted under 35 U.S.C. 154(b) by 0 days.

(21) Appl. No.: 09/489,070

(22) Filed: Jan. 21, 2000

(51) Int. Cl.[7] ..... B41L 23/00; B41L 25/00; B41F 31/00

(52) U.S. Cl. ..... 101/147; 101/349.1; 101/483

(58) Field of Search ..... 101/147, 148, 101/349.1, 483; 100/73

(56) References Cited

U.S. PATENT DOCUMENTS 2,320,523 * 6/1943 Jirousek ..... 101/147
2,395,151 * 2/1946 Sodomka ..... 101/147
5,619,920 * 4/1997 MacPhee ..... 101/141

* cited by examiner

*Primary Examiner*—Kimberly Asher

(57) ABSTRACT

A dampening train of rollers in an offset printing press system for delivering dampening solution to a plate cylinder in which the dampening train of rollers is independent of and separate from an inking train of rollers which provide ink to the plate cylinder. The dampening train of rollers has at least four rollers including a dampening solution transfer roller, a dampening form roller, a single mechanically driven drive roller, and at least one rider roller. The plate cylinder engages with the single dampening form roller which transfers an even application of dampening solution to the plate cylinder. The mechanically driven drive roller is surrounded by the dampening form roller and the rider rollers which are positioned at the supply side of the drive roller between the transfer roller and the form roller. The rider rollers and the single dampening form roller engage the single mechanically driven drive roller at different locations about the circumferential surface of the drive roller such that the drive roller provides rotational movement of the rider rollers and the single dampening form roller independently of the inking train of rollers.

29 Claims, 4 Drawing Sheets

DAMPENING SYSTEM FOR OFFSET PRINTING PRESS AND METHOD

BACKGROUND OF THE INVENTION

This invention pertains to a dampening roller assembly for delivering water to a printing plate of an offset printing press.

The offset printing process requires roller trains to deliver ink and water to printing plates. The ink and water can be delivered through the same roller train or through separate roller trains. If the water is delivered through its own independent roller train, it is called dampening roller train. The dampening roller train normally consists of several rollers, including a dampening form roller, dampening chrome roller, and possibly one or more dampening rider rollers. The form roller and rider roller are often friction driven which provide a "squeeze" operation to smooth out the water laydown and deliver even water film. The chrome roller is gear-driven and plated with oilphobic material (such as chrome) on the roller surface, which repels the ink and adheres to the water. The combination and total number of dampening rollers depend on the type of dampening delivery system and targeted printing quality. Two-roller, three-roller or four-roller trains arranged linearly in series are employed in conventional dampening delivery systems.

When pursuing higher printing quality and better water laydown uniformity, the utilization of more dampening rollers, to provide more nips, is often performed. However, the existing serial roller layout requires a significant amount of space, many gears and drive machinery for the driven rollers, and relies heavily on the covering condition for each individual roller and the nip setting in between rollers.

Currently there are three types of serial dampening roller layouts: two-roller trains, three-roller trains and four-roller trains. The two-roller serial train has one rubber dampening form roller and one chrome roller, and is widely used for low speed and normal printing quality applications. The dampening water is applied to a driven chrome roller first and is transferred through a form roller to reach the plate cylinder. There are only two nips involved in the water transferring and smoothing process for the serial dampening train of rollers.

The three-roller serial train provides one rubber dampening form roller, one driven chrome roller and one rubber dampening rider roller, and is used for medium-to-high speed and high print quality applications. The dampening water is applied to the rider roller first and is transferred through a chrome roller and a form roller to reach the plate cylinder. There are three nips involved in the water transferring and smoothing process for the serial dampening train of rollers.

The four-roller serial dampening train has one rubber dampening form roller, one driven chrome roller, one rubber dampening transfer roller and another driven chrome roller, and is used for high speed and high print quality applications. The supplied dampening water is applied to a driven chrome roller first and is then transferred through a transfer roller, another driven chrome roller and one water form roller to finally reach the plate cylinder. There are four nips involved in the water transferring and smoothing process in the four-roller serial dampening train. Due to the serial layout of the four-roller train, the physical parameters for each contact (i.e. nip setting, rubber material and durometer) between rollers become very crucial to the water transfer. Slight variances in the nip settings, rubber material or the durometer for the serially arranged rollers can be magnified significantly thereby potentially reducing print quality due to the serial arrangement of the rollers. Furthermore, in the four roller train, both of the driven chrome rollers are required to be gear-driven to prevent possible slippage which renders the gear train design more complicated and requires a significant amount of space to be dedicated for the motor and gear systems in the four-roller arrangement.

SUMMARY OF THE INVENTION

One or more of the problems noted above are solved in accordance with the present invention and a technical advance is achieved in the art, by a dampening train of at least four rollers for delivering water to a plate cylinder in which the rollers are configured in a satellite arrangement with a single drive roller being surrounded by and being engaged with a dampening solution transfer roller, a dampening form roller and at least one rider roller positioned at the supply side of the drive roller between the transfer roller and the form roller.

A method is achieved for delivering dampening solution to a plate cylinder in an offset printing press system having an inking train of rollers which provide ink to the plate cylinder and having an independent dampening train of rollers separate from the inking train to exclusively provide water to the plate cylinder. The method includes the steps of providing the dampening train of rollers with at least four rollers including a dampening solution transfer roller, a dampening form roller, a single mechanically driven drive roller and at least one rider roller; engaging the plate cylinder with the dampening form roller and surrounding the single mechanically driven drive roller with the dampening solution transfer roller, the dampening form roller and the rider rollers. The method includes the step of engaging at different locations about a circumferential surface of the drive roller, all of the rider rollers at different locations at a supply side of the drive roller between the dampening solution transfer roller and the dampening form roller such that the mechanically driven drive roller provides rotational movement of the rider rollers and the form roller independently of the inking train of rollers.

BRIEF DESCRIPTION OF THE DRAWINGS

The advantageous features of the invention will be explained in greater detail and others will be made apparent from the detailed description which is given with reference to the several figures of the drawing, in which.

DETAILED DESCRIPTION

Figure 1:
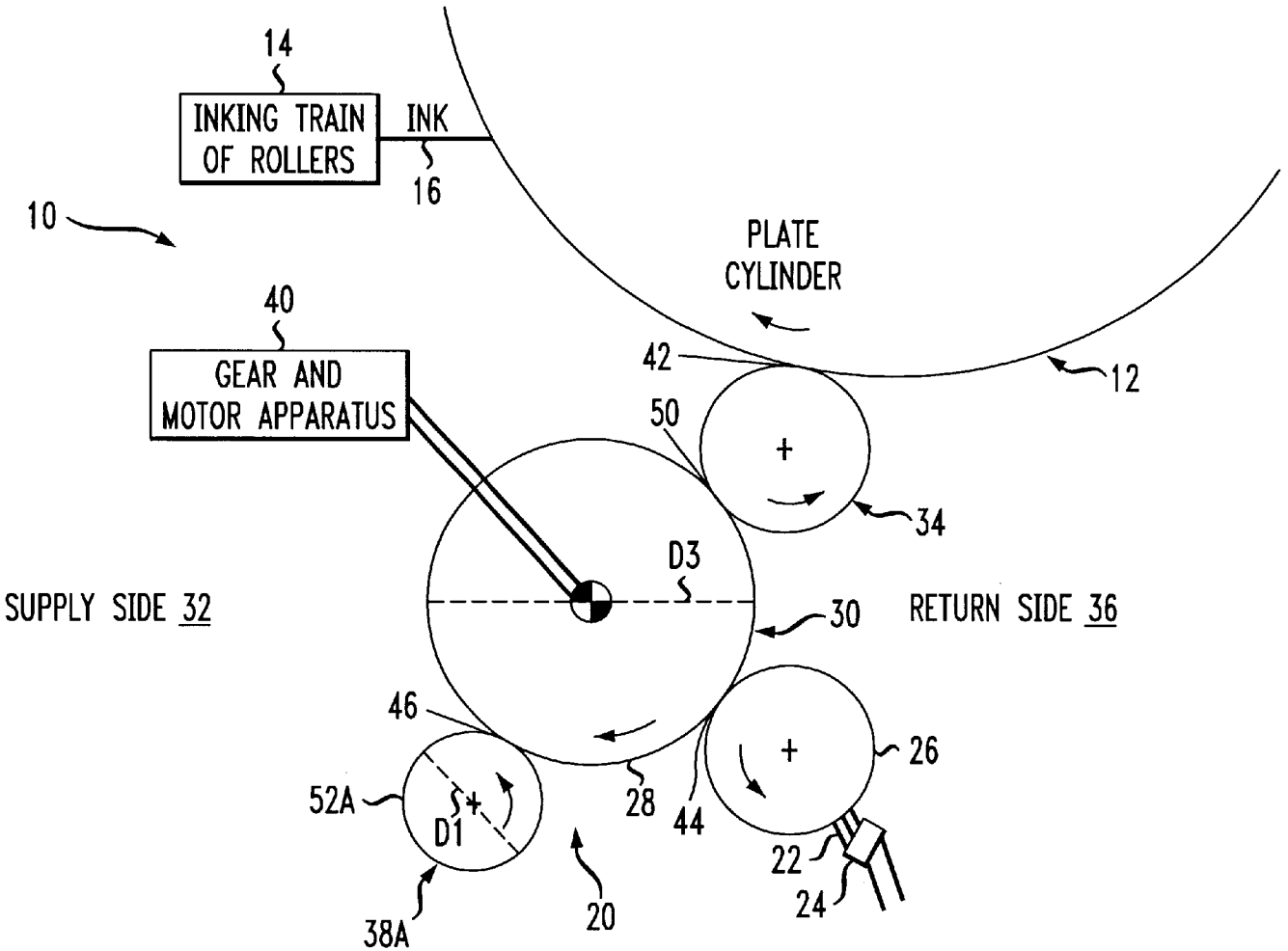
FIG. 1 is a schematic illustration of the offset printing press system having an inking train of rollers and separate independent dampening train of rollers for interaction with a plate cylinder.

Referring to FIG. 1, offset printing press system 10 is shown with a plate cylinder 12 and an inking train of rollers 14 for providing ink 16 to the surface of the plate cylinder 12. A dampening train of rollers 20 is shown for delivering dampening solution 22 to the plate cylinder. As seen in FIG. 1, the dampening train of rollers 20 is independent of and separate from the inking train of rollers 14 to exclusively provide dampening solution to the plate cylinder 12. A dampener apparatus 24, such as a spray bar, provides dampening solution 22 which is applied at the surface of a dampening solution transfer roller 26. Dampening solution may selectively be supplied to the transfer roller 26 by any suitable means such as by a sprayer apparatus 24, a non-contract spiral brush, contact durotrol, non-contract spray, or through a dampening pan and pan roller/transfer roller arrangement.

The dampening solution transfer roller 26 supplies the dampening solution 22 on to a circumferential surface 28 of mechanically driven drive roller 30. The dampening solution 22 is carried at the supply side 32 of the dampening train of rollers 20 and is transferred to a dampening form roller 34 which engages both the drive roller 30 and the plate cylinder 12 for applying the dampening solution to the plate cylinder. A certain amount of excess dampening solution may return along the return side 34 of the drive roller 30 moving clockwise (CW) toward the dampening solution transfer roller 26.

As seen in FIG. 1, a rider roller 38A is positioned at the supply side 32 of the dampening train 20 between the transfer roller 26 and the dampening form roller 34. The dampening solution transfer roller 26, the rider roller 38A and the dampening form roller engage and surround the single mechanically driven drive roller 30 in a satellite arrangement. The transfer roller 26, rider roller 38A and form roller 34 engage the drive roller 30 at different locations about the circumferential surface 28 of the drive roller 30. The rider roller 38A of the dampening train 20 engages the mechanically driven drive roller 30 at the supply side 32 of the drive roller between the dampening solution transfer roller 26 and the dampening form roller 34 such that the drive roller 30 provides rotational movement of the rider roller 38A and the form roller 34 independently of the inking train of rollers 14. The placement of the rider roller 38A at the supply side 32 which engage with the outer surface 28 of the drive roller 30 allows the rider roller to even out and establish a consistent layer of dampening solution to create an effective impression stripe of the dampening solution before the dampening solution reaches the dampening form roller 34.

To rotate the rollers in the dampening train 20, only a single gear and motor apparatus 40 is required to drive the single mechanically driven drive roller 30. Advantageously, unlike conventional serial arrangements, the satellite arrangement of the dampening train of rollers 20 requires only a single drive roller 30 connected with a single associated gear and motor driving apparatus 40 to provide adequate rotation of the rollers for the transfer of an even stream of dampening solution to the plate cylinder 12. As seen in the embodiment of FIG. 1, the single mechanically driven drive roller 30 rotates clockwise (CW) to drive the transfer roller 26, rider roller 38A and the form roller 34 which engage with the drive roller surface 28 and accordingly rotate in a counter clockwise (CCW) direction. The single gear and motor driven drive roller 30 with the satellite arrangement of the rider roller, transfer roller and form roller enable the entire dampening roller train and related gear train to be more compact and simple even for high quality print applications.

The satellite arrangement of the rollers about the supply side of the drive roller 30 provides for a high number of nips in the dampening train 20. As seen in FIG. 1, a nip 42 is established at an engagement point of the plate cylinder 14 and the dampening form roller 34 for the transfer of dampening solution to the plate cylinder. A plurality of additional nips are established at different locations about the circumferential surface of the single mechanically driven drive roller 30. A nip 44 is located at the engagement point of the dampening solution transfer roller 26 and the drive roller 30. Nip 46 is located at the engagement point of the rider roller 38A and the drive roller 30. Nip 50 is located at the engagement point of the dampening form roller 34 with the circumferential surface 28 of the drive roller 30. The addition of rider roller 38A creates an additional nip 46 along the supply side 32 of the drive roller 30 to increase the effectiveness of the smoothing process in creating an impression stripe of the dampening solution 32 which is carried to the form roller 34 for transfer to the plate cylinder.

The single gear and motor apparatus 40 connected with the single drive roller 30, upon activation initiates the frictional rotational movement of the dampening solution transfer roller 26, the dampening form roller 34 and the rider roller 38A. The mechanically driven drive roller 30, when rotated by drive apparatus 40, frictionally drives the dampening solution transfer roller 26, the rider roller 38A and the form roller 34 for rotational movement of the transfer roller, the rider roller and the form roller. Rotational movement of the rider roller 38A engaged at the supply side 32 of the drive roller 30 is solely provided by the frictional engagement with the single mechanically driven drive roller 30.

To transfer the dampening solution 22 from the dampening solution transfer roller 26 to the form roller 34, the circumferential surface 28 of the drive roller 30 is preferably plated with a hydrophilic and oilphobic compound such as chrome. The outer surface of the rider roller 38A is made of a rubber compound material for proper transfer of the dampening solution along the supply side 32 of the drive roller 30.

Figure 2:
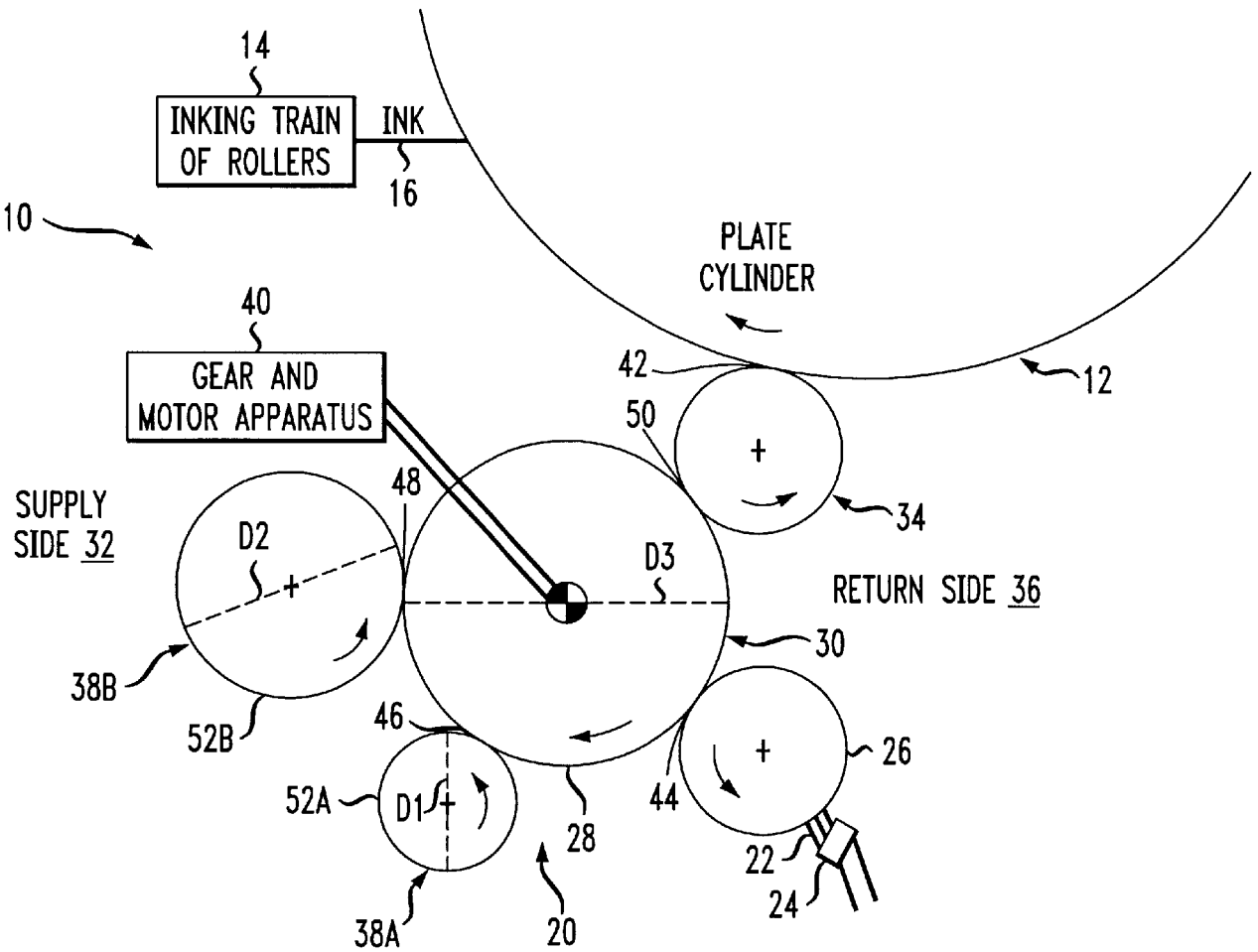
FIG. 2 is another embodiment of the printing press system of FIG. 1 having an additional rider roller.

Referring now to FIG. 2, another embodiment of the dampening train of rollers 20 in the offset printing press system 10 is shown having an additional rider roller 38B engaging the surface 28 of the drive roller 30. In similar fashion to the arrangement of FIG. 1, rider roller 38B, FIG. 2, engages the single mechanically driven drive roller 30 at a location 48 on the supply side 32 of the circumferential surface 28 of the drive roller between the dampening solution transfer roller 26 and the dampening form roller 34 for frictional rotational movement of the additional rider roller 38B. Rider roller 38B has a different diameter length $D_2$ from the diameter lengths $D_1$ of rider rollers 38A, with diameter length $D_2$ of rider roller 38B being less than the diameter $D_3$ of the drive roller 30. The establishment of a plurality of nips 46, 48 along the supply side 32 of the drive roller 30 permits each rider roller 38A, 38B to have a different diameter length. Different sized rider rollers randomize the laydown pattern of the dampening solution 22 and reduce the variation of the dampening solution 22 provided by the dampener apparatus 24. Rider roller 38A has a diameter length $D_1$ which is less than the diameter length $D_2$ of rider roller 38B. Additionally, as seen in FIG. 1, the mechanically driven drive roller 30 has a diameter length $D_3$ which is greater than each of the diameter lengths $D_1$, $D_2$ of rider rollers 38A, 38B. Another advantage resulting from the satellite arrangement of rollers as seen in FIG. 1 is that, unlike conventional serial arrangements, the outer circumferential surfaces 52A, 52B of the rider rollers 38A, 38B are selectively enabled to be formed of different covering materials. Each rider roller with different covering material can possess its own unique water holding and transferring characteristic, and material aging process. Advantageously, in the dampening train of rollers 20, additional rider rollers can be easily added to the flexible satellite layout to meet high quality printing requirements.

Figure 3:
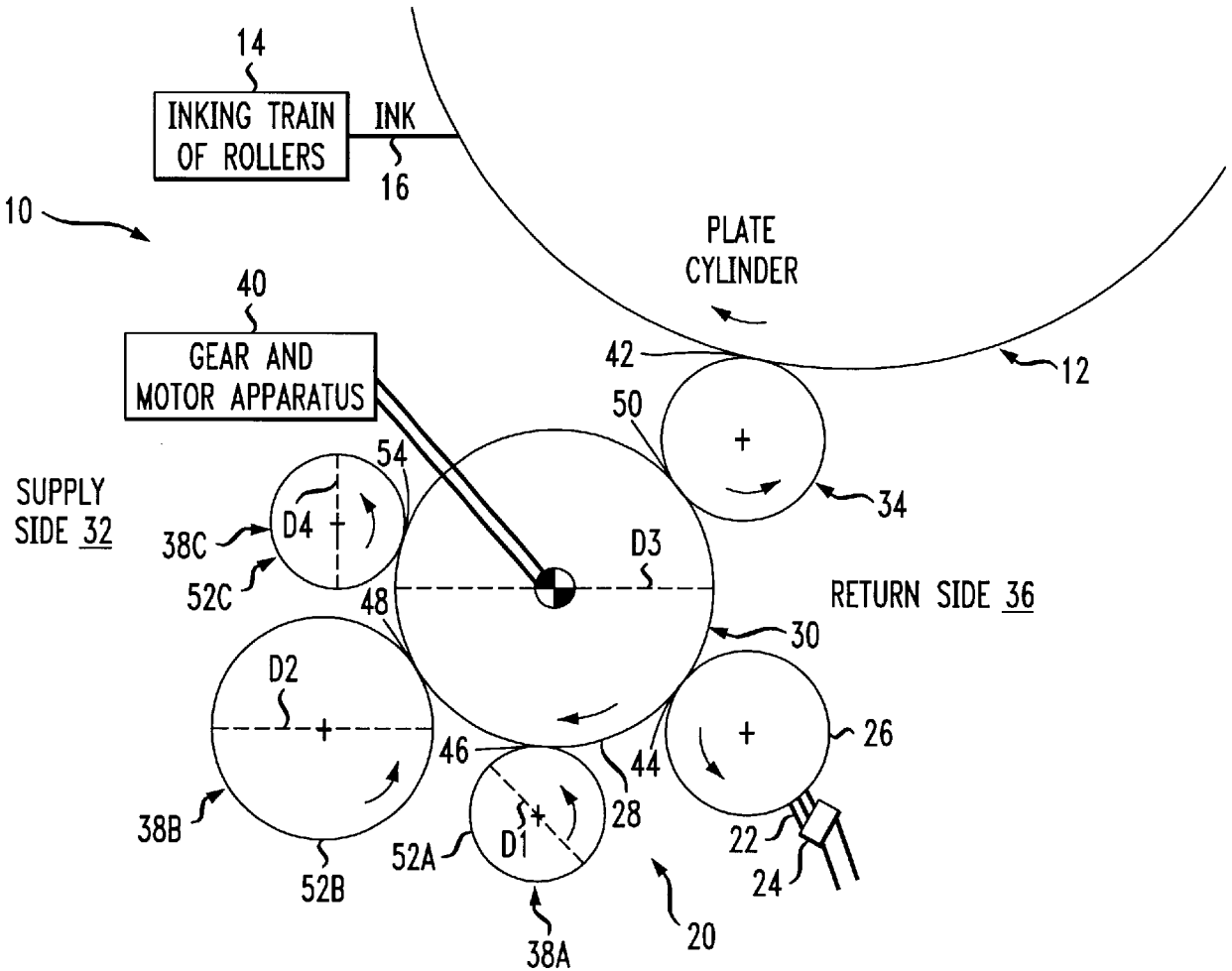
FIG. 3 is another embodiment of the printing press system of FIG. 1 having two additional rider rollers.

Referring now to FIG. 3, another embodiment of the dampening train of rollers 20 in the offset printing press system 10 is shown having an additional rider roller 38C engaging the surface 28 of the drive roller 30. In similar fashion to the arrangement of FIG. 2, rider roller 38C, FIG. 3, engages the single mechanically driven drive roller 30 at a location 54 on the supply side 32 of the circumferential surface 28 of the drive roller between the dampening solution transfer roller 26 and the dampening form roller 34 for frictional rotational movement of the additional rider roller 38C. Rider roller 38C has a different diameter length $D_4$ from the diameter lengths $D_1$, $D_2$ of rider rollers 38A, 38B with diameter length $D_4$ of rider roller 38C being less than the diameter $D_3$ of the drive roller 30. The addition of rider roller 38C creates an additional nip 54 along the supply side 32 of the drive roller 30 to increase the effectiveness of the smoothing process in creating an additional impression stripe of the dampening solution 22 which is carried to the form roller 34 for transfer to the plate cylinder. The additional rider roller further randomizes the laydown and evenness of the fountain solution 22.

Figure 4:
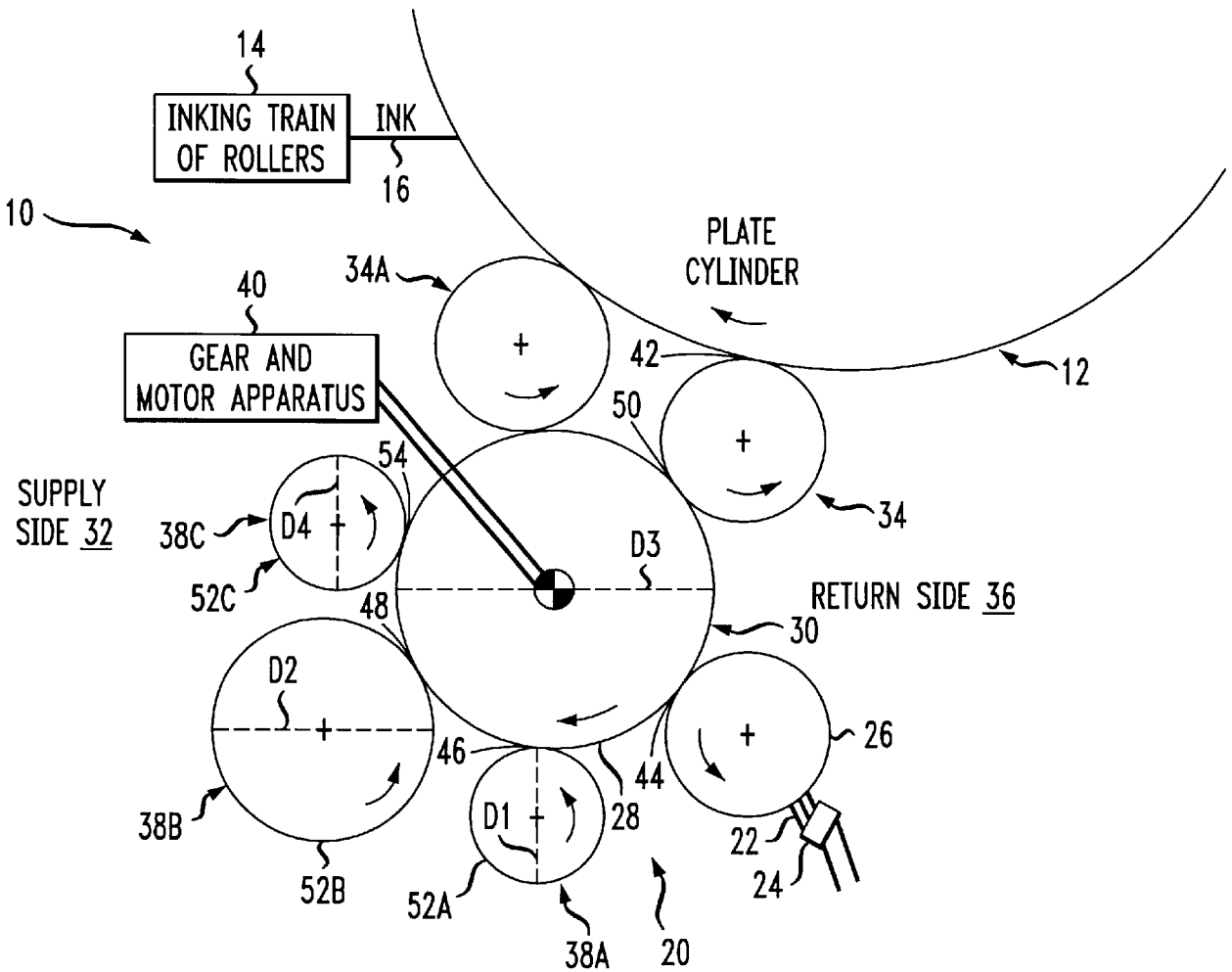
FIG. 4 is another embodiment of the printing press system having an additional dampening form roller engaging the plate cylinder.

Referring to FIG. 4, another embodiment of the offset printing press system 10 is shown having another dampening form roller 34A. The additional dampening form roller 34A is engaged with the plate cylinder 12 and the surface 28 of the single mechanically driven drive roller 30 to transfer dampening solution received from the drive roller onto the plate cylinder surface. The other dampening form roller 34A, as seen in FIG. 4, is preferably positioned between the dampening solution transfer roller 26 and dampening form roller 34. The additional dampening form roller 34A is also positioned downstream of all of the rider rollers 38A, 38B and 38C engaging the drive roller 30 at the supply side 32 of the dampening train of rollers 20. The additional form roller provides the second passage to apply the dampening solution 22 to the plate cylinder 12.

A method is accomplished in the present invention for delivering to a plate cylinder in an offset printing press system having an inking train of rollers which provide ink to the plate cylinder in which the printing press system has an independent dampening train of rollers separate from the inking train to exclusively provide dampening solution to the plate cylinder. The method includes the steps of providing at least four rollers in the dampening train of rollers including a dampening solution transfer roller, a dampening form roller, a single mechanically driven drive roller and at least one rider roller; engaging the plate cylinder with the dampening form roller; surrounding the single mechanically driven drive roller with the dampening solution transfer roller, the dampening form roller and the rider rollers; and engaging all of the rider rollers at different locations about the circumferential surface of the single mechanically driven drive roller at the supply side of the drive roller between the dampening solution transfer roller and the form roller such that the single mechanically driven drive roller provides rotational movement of the rider rollers and the dampening form roller independent of the inking train of rollers.

In performing the method, the step of supplying, from the transfer roller 26, dampening solution 22 to the surface 28 of the single mechanically driven drive roller 30 is accomplished. The step of evening the dampening solution 22 with the rider roller 38A to establish an impression stripe before the dampener solution reaches the dampening form roller 34 is performed. The dampening solution 22 is carried at the surface 28 of the drive roller 30 and is received at the dampening form roller 34. The step of applying the dampening solution 22 received at the form roller 34 to the plate cylinder 12 is then performed. As seen in FIG. 1, the rider roller 38A of the dampening train of rollers 20 is positioned between the transfer roller 26 and the form roller 34 about the circumferential surface 28 at the supply side 32 of the drive roller 30. Rotational movement of each of the rider roller 38A is solely provided by the mechanically driven drive roller 30 frictionally engaged therewith. A nip 42 is established at an engagement point of the plate cylinder 12 and the dampening form roller 30. At least three other nips 44, 46, 50 are established at different locations about the circumferential surface 28 of the drive roller 30 in response to the engagement of the dampening transfer roller 26, the rider roller 38A and the dampening form roller 34 about the surface of the drive roller.

As seen in FIG. 2, each rider roller 38A, 38B is provided with a different diameter length $D_1$, $D_2$ to vary the rider roller size. The mechanically driven drive roller 30 is preferably provided with a diameter length $D_2$ which is greater than the length of each of the diameter lengths $D_1$, $D_2$ of each rider roller 38A, 38B. The outer circumferential surface 52A, 52B of each rider roller 38A, 38B is provided with a rubber compound to provide selective pressure levels against the drive roller 30 to create an impression stripe for the transfer of dampening solution 22 about the surface 28 of the drive roller 30. Based on the particular printing application desired, the step of providing different types of covering materials about the surfaces of each of the rider rollers 38A, 38B is accomplished. The step of varying the types of covering materials placed about the surfaces of the rider rollers 38A, 38B is performed. For the drive roller 30, the step of plating the surface 28 of the drive roller with an oilphobic material such as chrome is performed.

As seen in FIG. 3, an additional rider roller 38C, is shown added to rider rollers 38A, 38B making a total of three rider rollers engaging the drive roller surface 28 at the supply side 32 of the drive roller 30. In the method, the step of adding at least one additional rider roller 38C to be included in the dampening train of rollers 20 such that the additional rider roller 38C engages the drive roller 30 at a location 54 on the circumferential surface 28 of the drive roller between the transfer roller 26 and form roller 34 for frictional movement of rider roller 38C is performed. In the preferred printing press system, the step of activating a single gear and motor apparatus 40 to drive the single mechanically driven drive roller 30 to initiate rotational movement of all the rider rollers 38A, 38B, 38C and the dampening form roller 34 in the dampening train 20 is accomplished.

As seen in FIG. 4, another dampening form roller 34A is added to the dampening train of rollers 20. The method of providing dampening solution to the plate cylinder includes the step of engaging the other plate cylinder 34A with the plate cylinder 12 and the circumferential surface 28 of the single mechanically driven drive roller 30. The step of positioning the other dampening form roller 34A between the dampening solution transfer roller 26 and the dampening form roller 34 is performed. As seen in FIG. 4, the additional dampening form roller 34A is positioned downstream of all of the rider rollers 34A, 34B and 34C engaging the drive roller 30 at the supply side 32 of the dampening train 20.

While a detailed description of the preferred embodiments of the invention have been given, it should be appreciated that many variations can be made thereto without departing from the scope of the invention as set forth in the appended claims.

What is claimed is:

1. A method of delivering dampening solution to a plate cylinder in an offset printing press system having an inking train of rollers which provide ink to the plate cylinder and having an independent dampening train of rollers separate from the inking train to exclusively provide dampening solution to the plate cylinder comprising the steps of:

providing at least four rollers in the dampening train of rollers including a dampening solution transfer roller, a dampening form roller, a single mechanically driven drive roller and at least one rider roller;

engaging the plate cylinder with the dampening form roller;

surrounding the single mechanically driven drive roller with the dampening solution transfer roller, the dampening form roller and the at least one rider roller; and engaging the at least one rider roller at a location about a circumferential surface of the single mechanically driven drive roller at a supply side of the drive roller between the dampening solution transfer roller and the dampening form roller such that the single mechanically driven drive roller provides rotational movement of the at least one rider roller and the dampening form roller independent of the inking train of rollers.

2. The method of claim 1 including the steps of establishing a nip at an engagement point of the plate cylinder and the dampening form roller, and establishing at least three nips at different locations about the circumferential surface of the drive roller in response to the engagement of the at least one rider roller, the dampening transfer roller and the dampening form roller about the surface of the drive roller.

3. The method of claim 2 including the step of plating the surface of the mechanically driven drive roller with an oilphobic material.

4. The method of claim 3 in which the oilphobic material is chrome.

5. The method of claim 3 including the step of engaging at least two rider rollers at different locations about the circumferential surface of the drive roller at the supply side of the drive roller between the transfer roller and the dampening form roller.

6. The method of claim 5 in which rotational movement of each of the rider rollers is solely provided by the mechanically driven drive roller frictionally engaged therewith.

7. The method of claim 6 including the step of positioning each rider roller of the dampening train of rollers at different locations between the transfer roller and form roller about the circumferential surface at the supply side of the drive roller.

8. The method of claim 6 including the step of providing each rider roller with a different diameter length.

9. The method of claim 8 including the step of providing the mechanically driven drive roller with a diameter length which is greater than each of the diameter lengths of each of the rider rollers.

10. The method of claim 9 including the step of providing the surface of each of the rider rollers with a rubber compound to provide an impression stripe for transfer of dampening solution about the drive roller.

11. The method of claim 6 including the step of providing different types of covering materials about the surfaces of each of the rider rollers.

12. The method of claim 6 including the step of varying types of covering materials placed about the surfaces of the rider rollers.

13. The method of claim 6 including the step of adding at least one additional rider roller to be included in the dampening train of rollers such that the at least one additional rider roller engages the drive roller at a location on the circumferential surface of the drive roller between the transfer roller and the form roller for frictional movement of the additional rider roller.

14. The method of claim of claim 6 including the step of activating a single gear and motor apparatus to drive the single mechanically driven drive roller to initiate rotational movement of all of the at least two rider rollers and the dampening form roller in the dampening train of rollers.

15. The method of claim 6 including the steps of supplying, from the transfer roller, dampening solution to the surface of the single mechanically driven drive roller, evening the dampening solution to establish an impression stripe with the at least one rider roller before the dampening solution reaches the dampening form roller, receiving the dampening solution at the dampening form roller, and applying the dampening solution received at the dampening form roller to the plate cylinder.

16. The method of claim 6 including the steps of engaging another dampening form roller with the plate cylinder and the circumferential surface of the single mechanically driven drive roller, and positioning the other dampening form roller between the dampening solution transfer roller and the dampening form roller and downstream of all of the rider rollers engaging the drive roller at the supply side of the dampening train of rollers.

17. A dampening train of rollers for delivering dampening solution to a plate cylinder in an offset printing press system having an inking train of rollers which provides ink to the plate cylinder in which the dampening train of rollers are independent and separate from the inking train of rollers to exclusively provide dampening solution to the plate cylinder, the dampening train of rollers comprising:

a dampening form roller adapted for engagement with the plate cylinder;

a dampening solution transfer roller;

at least one rider roller positioned at a supply side of the dampening train between the transfer roller and dampening form roller; and a single mechanically driven drive roller in which the dampening solution transfer roller, dampening form roller and the at least one rider roller engage the drive roller at different locations about a circumferential surface of the drive roller and in which the at least one rider roller engages the drive roller at the supply side of the drive roller between the dampening solution transfer, roller and the dampening form roller such that the single mechanically driven drive roller, upon engagement of the dampening form roller with the plate cylinder, provides rotational movement of the at least one rider roller and the dampening form roller independent of the inking train of rollers.

18. The dampening train of rollers of claim 17 including a nip that is adapted to be located at an engagement point of the plate cylinder and the dampening form roller, and at least three additional nips at different locations about the circumferential surface of the single mechanically driven drive roller at engagement points of the dampening transfer roller, the at least one rider roller and the dampening form roller with the circumferential surface of the drive roller.

19. The dampening train of rollers of claim 17 including at least two rider rollers positioned at the supply side of the dampening train between the transfer roller and the dampening form roller and in which the transfer roller, the dampening form roller and all of the at least two rider rollers engage the drive roller at different locations about the circumferential surface of the drive roller and in which all of the rider rollers engage the drive roller at the supply side between the transfer roller and form roller such that the single mechanically driven drive roller, upon engagement of the dampening form roller with the plate cylinder, provides rotational movement of the rider rollers and the dampening form roller independent of the inking train of rollers.

20. The dampening train of rollers of claim 19 in which the circumferential surface of the mechanically driven drive roller is plated with chrome.

21. The dampening train of rollers of claim 19 in which the mechanically driven drive roller frictionally drives each of the rider rollers and the dampening form roller for rotational movement of the rider rollers and the form roller.

22. The dampening train of rollers of claim 19 in which rotational movement of each of the rider rollers engaged at the supply side of the drive roller is solely provided by the single mechanically driven drive roller frictionally engaged therewith.

23. The dampening train of rollers of claim 22 including a gear and motor apparatus connected with the single mechanically driven drive roller to drive the drive roller and initiate frictional rotational movement of the dampening transfer roller, the dampening form roller and the at least one rider roller.

24. The dampening train of rollers of claim 22 in which each rider roller has a different diameter length.

25. The dampening train of rollers of claim 24 in which the mechanically driven drive roller has a diameter length which is greater than each of the diameter lengths of each of the rider rollers.

26. The dampening train of rollers of claim 22 in which the surface of each of the rider rollers is made of a rubber compound material.

27. The dampening train of rollers of claim 22 in which the surfaces of each of the rider rollers are each formed of different covering materials.

28. The dampening train of rollers of claim 22 including at least one additional rider roller which engages the single mechanically driven drive roller at a location on the supply side of the circumferential surface of the drive roller between the dampening solution transfer roller and the dampening form roller for frictional movement of the additional rider roller.

29. The dampening train of rollers of claim 22 including another dampening form roller engaged with the plate cylinder and the single mechanically driven drive roller in which the other dampening form roller is positioned between the transfer roller and the dampening form roller and is downstream of all of the rider rollers engaging the drive roller at the supply side of the dampening train of rollers.

* * * * *